United States Patent [19]

Holley et al.

[11] 4,197,608

[45] Apr. 15, 1980

[54] ROLLING HAIRBRUSH

[75] Inventors: Boyce B. Holley, Hurst; James R. Warren, Watauga, both of Tex.

[73] Assignee: S. E. Jones, Dallas, Tex.

[21] Appl. No.: 19,177

[22] Filed: Mar. 9, 1979

Related U.S. Application Data

[63] Continuation-in-part of Ser. No. 937,941, Aug. 30, 1978.

[51] Int. Cl.[2] ..... A46B 7/10

[52] U.S. Cl. ..... 15/27; 15/159 R; 132/118

[58] Field of Search ..... 15/27, 159 R, 159 A, 15/23, 160; 132/9, 11 A, 118, 151

[56] References Cited

U.S. PATENT DOCUMENTS

| | | | |
|---|---|---|---|
| 1,393,635 | 10/1921 | Mondy | 15/159 A |
| 2,474,106 | 6/1949 | Jackson et al. | 132/118 |
| 3,909,868 | 10/1975 | Nogues | 15/27 |

FOREIGN PATENT DOCUMENTS

| | | | |
|---|---|---|---|
| 1222686 | 1/1960 | France | 15/27 |

*Primary Examiner*—Edward L. Roberts

*Attorney, Agent, or Firm*—Hubbard, Thurman, Turner, Tucker & Glaser

[57] ABSTRACT

A hairbrush of the cylindrical bristle type in which a brush head carrying the bristles is rotatably connected to a brush handle. The brush head includes a portion adjacent to the handle which is free of bristles having a roughened surface to allow manual control of rotation of the brush head relative to the brush handle. In one form a heating element is included within the brush head.

6 Claims, 5 Drawing Figures

ROLLING HAIRBRUSH

BACKGROUND OF THE INVENTION

This is a continuation-in-part of copending application Ser. No. 937,941, filed Aug. 30, 1978.

This invention relates to hairbrushes, and in particular to a rotary hairbrush which is manually controlled and includes a heating element within the brush head.

Prior art which is believed to be relevant to the present invention includes the following: U.S. Pat. No. 1,766,140, issued to Narducci on June 24, 1930, U.S. Pat. No. 3,019,463, issued to Mitchell on Feb. 6, 1962, U.S. Pat. No. 3,386,453, issued to Roberts et al on June 4, 1968, U.S. Pat. No. 3,427,674, issued to Tone et all on Feb. 18, 1969 and U.S. Pat. No. 3,431,571, issued to Kraus on Mar. 11, 1969. Each of these patents illustrated some type of rotary hairbrush or rotary comb arrangement which is mechanically driven, for example, by an electric motor. The primary object of such arrangements is to increase the effective number of brush strokes realized from a single manual stroke of the brush mechanism through hair. That is, the mechanical drive increased the rage of advance of the bristles through the hair beyond the actual rate of motion of the brush mechanism. Such mechanical driving mechanism obviously increase the complexity and therefore the cost of such rotary brushes.

In addition to the brushing and other styling operations which can be performed with standard or rotary combs or brushes, it has become standard practice to use heated curlers, curling irons or blow dryers in conjunction with brushing devices. Such styling operations therefore require more pieces of equipment to perform and some of the heated devices have inherent disadvantages. For example, the curling irons are quite commonly the source of burns when the iron accidently is allowed to touch the skin. The blow dryer, while being used to dry the hair, also tends to disturb the overall contour of the styling operation. Thus, while it is seen that it is desireable to apply heat to hair during a styling operation, there is room for improvement in the heating apparatus.

SUMMARY OF THE INVENTION

Accordingly, an object of the present invention is to provide an improved yet simple hair brush having a rotatable cylindrical brush head.

Another object of the present invention is to provide a rotatable or rolling hairbrush which does not employ a mechanical or electrical rotating drive source.

Yet another object of this invention is to provide a rolling hairbrush having a heating element within the brush head.

An improved hairbrush according to the present invention includes a cylindrical brush head rotatably attached to a brush handle. The brush head includes a portion adjacent to the brush handle which is free of bristles but which has a knurled or roughened surface to provide a means for controlling the brush head with respect to the brush handle. A heating element is carried within the brush head.

BRIEF DESCRIPTION OF THE DRAWINGS

The present invention may be more fully understood by reading the following detailed description of the preferred embodiments with reference to the drawings wherein.

DESCRIPTION OF THE PREFERRED EMBODIMENTS

Figure 1:
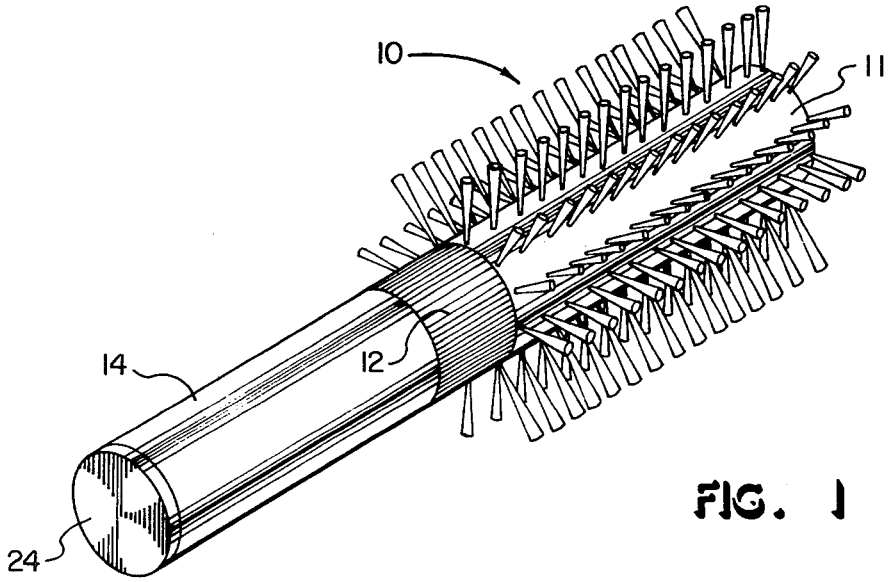
FIG. 1 is a perspective view of a rolling hairbrush according to the present invention.

A preferred form of the present invention is illustrated generally in FIG. 1. The rolling hairbrush as illustrated includes a cylindrically shaped bristle section 10 in which the bristles extend essentially radially from a brush head 11.

A portion 12 of the brush head 11 contains no bristles but has an intentionally roughened or knurled surface so that a good manual grip may be made on this portion of the brush head. The brush head 11 is rotatably connected to a handle 14 illustrated as having a generally cylindrical shape. It is apparent that handle 14 could have a contoured surface designed to better fit the fingers of a person using the brush.

Figure 2:
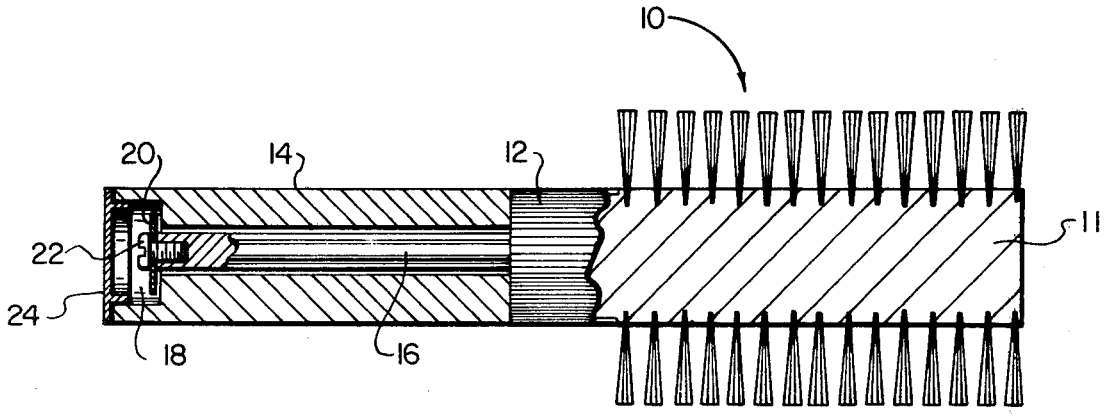
FIG. 2 is a cross-sectional illustration of the rolling hairbrush illustrated in FIG. 1.

The details of construction of the brush of FIG. 1 are better shown in the cross-sectional illustration of FIG. 2. As shown in FIG. 2, the bristles in section 10 are embedded in groups into the brush head 11 in a conventional manner. Also, as illustrated, the portion of the brush head 11 in which the bristles are embedded is of the same diameter as the control section 12 which simplifies manufacturing procedures. While the same diameter arrangement is preferred, it is not essential to the present invention. In any case, the bristle section 10 and the control section 12 are either made from the same piece of material or are bonded together so that rotation of one causes rotation of the other. The handle 14 has a cylindrical hole along its central axis to facilitate the connection of the brush head to the handle. The brush head 11 has a small shaft 16 extending from control section 12 of a diameter to fit easily through the hole in handle 14. Handle 14 has a recess 18 in its end opposite the brush head 11 for receiving some means for retaining shaft 16 within handle 14. As illustrated, a washer 20 and a small bolt 22 are provided for retaining the shaft 16 within the handle 14. The bolt 22 should be tightened against shaft 16 and not against the bottom of the recess 18 so that a small amount of end play results and thereby the rotation of the brush head relative to the handle is not impeded. While prior art rotary brushes have employed special bearings, e.g. ball bearings, such complicated arrangements are not believed necessary for the present invention. It is preferred that handle 14 and/or shaft 16 be made of somewhat self-lubricating plastic materials such as nylon, teflon or delrin. Washer 20 should likewise be made of, for example, nylon. A dry bearing arrangement using such materials is quite suitable for the present rolling hairbrush in which slow rotational rates are encountered. Also illustrated in FIG. 2 is an end cap 24 covering recess 18 merely for aesthetic purposes.

Figure 3:
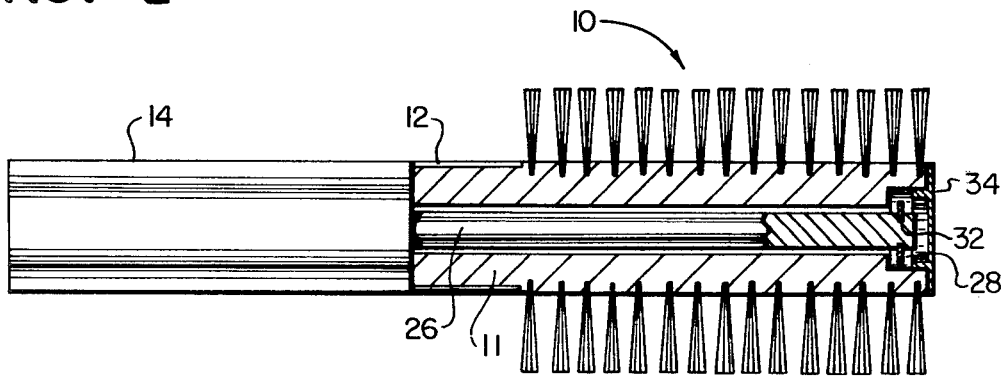
FIG. 3 is a cross-sectional view of a second embodiment of a rolling hairbrush according to the present invention.

A second possible embodiment of the present invention is illustrated in FIG. 3. A bristle portion 10 and control portion 12 of the brush head 11 are the same as illustrated in FIGS. 1 and 2. Likewise, the handle portion 14 is essentially the same as that illustrated in FIGS. 1 and 2 except that handle 14 has a shaft 26 extending from one end. In FIG. 3 the brush head 11 has a cylindrical hole along its axis for accomodating shaft 26. The brush head 11 has a recess 28 in its end opposite the handle 14 for receiving means for attaching the shaft 26 to the brush head. Instead of using a threaded bolt arrangement as shown in FIG. 2, the shaft 26 simply has a groove near its end for receiving a snap ring 32. If desired a washer made of, for example, nylon may be positioned between the bottom of recess 28 and the snap ring 32 to reduce friction. If the brush head 12 is made from a self-lubricating plastic material and the snap ring 32 is made from steel the additional washer should not be necessary. A decorative end cap 34 is also employed to cover the recess 28 in the brush head 11.

The above described embodiments both provide rolling hairbrushes in which the brush head 11 is freely rotatable relative to the brush handle 14. That is, if the brush is gripped merely by handle 14 and brushing in the normal manner is attempted, the brush head 12 will simply roll across the hair instead of brushing through it. The purpose of the control section of brush head 12 is to provide means of controlling or stopping the rotation of the brush head when brushing is performed. This control may be performed simply by placing the thumb on the knurled section between the thumb and the forefinger while gripping the handle 14 with the remaining fingers. Such an arrangement allows not only control of the rolling rate of the brush head but also allows the brush head to be turned in either direction while brush handle 14 is essentially stationary.

Thus the rolling brush may be used as a standard hairbrush by tightly gripping the control section of the head 12 to prevent all rotation while brushing is performed. When brushing for the purpose of detangling hair, whether wet or dry, the grip on the control section may be reduced as tangles are encountered to allow the brush head to at least partially roll past tangled areas without breaking hair due to excessive force being applied. The rolling action not only relieves pressure but provides a spiking motion of the bristles moving into and out of the tangled hair mass which has been found to aid in detangling the knots of hair. That is, the rolling action itself performs a detangling action.

Various hair styling functions can also be performed with the rolling hairbrush of the present invention. For example, by stopping a brush stroke occasionally and twisting the brush head 11 backwards a short distance a styled in lift may be accomplished. Likewise, while using a blow dryer, hair may be curled by placing the tips of the hair on the brush head and winding hair onto the brush head by use of the control section 12. When the curl is completed, the brush head is simply rolled from the hair. A final hair placement may be accomplished by touching the bristles to the surface of the hair and rotating the thumb control to lift and place the outer layer of hair without disturbing the overall contour.

Figure 4:
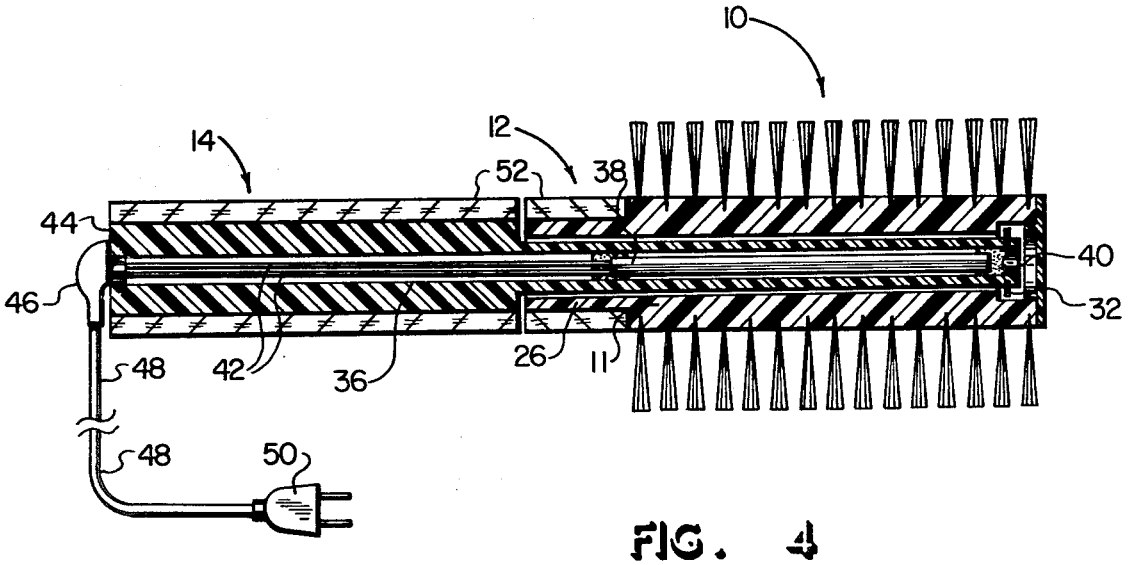
FIG. 4 is a cross-sectional view of an embodiment similar to the FIG. 3 form but including a heating element.

With reference now to FIG. 4, there is illustrated a further improvement to the above described rolling hairbrush which includes a heating element to allow heat to be applied to the hair during styling operations as described above. This FIG. 4 embodiment is somewhat like the FIG. 3 embodiment and the same designation numbers are used where appropriate. In particular, the FIG. 4 embodiment includes a handle shown generally at 14, having a shaft 26 extending from one end thereof, and a brush head 11 rotateably positioned on the shaft 26. Brush head 11 includes a bristle portion 10 and a control section 12 adjacent to handle 14.

A centrally located aperture 36 extends through handle 14 and shaft 26. A heater element 38 is positioned within this aperture 36 in the portion of the shaft 26 corresponding to the bristle section 10. Heater 38 may be bonded within this aperture 36 by means of a adhesive material 40, which preferably fills all space between the heater 38 and the shaft 26 to improve thermal conduction. A pair of electrical conductors 42 extends through the remainder of aperture 36 to the base 44 of handle 14. At base 44 an electrical connector 46 is provided for connecting conductors 42 to a standard electrical lead-in wire 48 provided with a plug 50 for connection to a wall outlet. Electrical connector 46 may simply be a molded rubber part for reducing bending strees on the wire 48, but is preferably a rotary connection which allows the entire brush to be rotated without twisting the wire 48.

The brush head 11 is held on to the shaft 26 by means of the snap ring 32 in the manner as described above with respect to FIG. 3. But in this embodiment, it is preferred that a close fit be provided between brush head 11 and the shaft 26 to improve thermal conduction from the heater to the brush head itself. It may additionally be desireable to use a lubricant to fill the space between the shaft 26 and the brush head 11 since this would also improve the conduction of heat from the heater 38 to the brush head 11.

It is preferred that a layer of insulating material 52 be provided on the handle 14 and control section 12. This layer reduces the conduction of heat from heater 38 to the gripping portions of the device. It is preferred that the insulating material 52 be a layer of cork material since this provides adequate thermal insulation, a good gripping surface and in addition is quite decorative. Other materials such as foamed plastic could be used for insulating layer 52. A contemplated alternative is to simply mold in fairly deep grooves in the handle 14 and control section 12 which act as cooling fins to cool the surfaces and at the same time provide a very good gripping surface.

Figure 5:
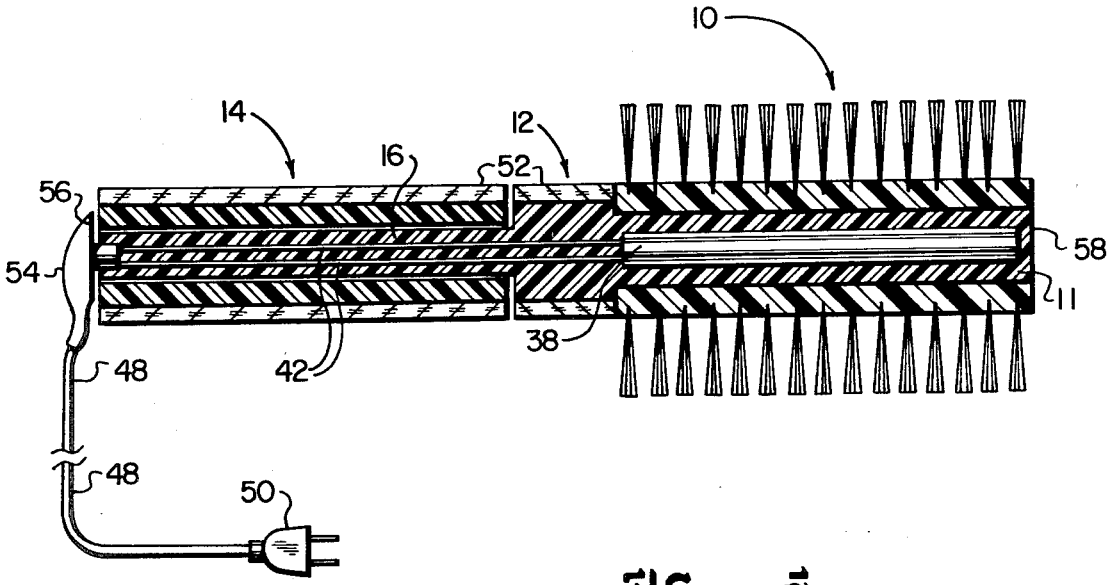
FIG. 5 is a cross-sectional view of an embodiment similar to FIG. 2 but including a heating element.

With reference now to FIG. 5, there is illustrated a second embodiment of a rolling hair brush having an internal heater element. This embodiment is similar to the FIG. 2 embodiment and the same designation numbers are again used where appropriate. This embodiment comprises basically a handle portion 14 and a brush head 11. The brush head 11 has a bristle section 10 and control section 12 and in addition has a shaft 16 extending from the control end of the brush head 11. A heater 38 may be identical to the heater element of FIG. 4. It is preferrably molded within the brush head 11 which is preferrably made of some type of plastic material. The brush head 11 could have a cylindrical hole for mounting the heater 38 in the manner shown in FIG. 4, but in this preferred form, the heater 38 and conductors 42 are simply molded into the brush head 11 and shaft 16 at the time they are formed. At the base of handle 14, and connected to one end of shaft 16, there is a rotary electrical connector 54 having one pair of inputs connected to the conductors 42. Connector 54 has a second pair of inputs connected to the power supply line 48 and plug 50, for connection to a typical wall electrical outlet.

When assembled as shown, the electrical connector 54 not only provides a rotary electrical connection but can also be used to hold the rotary handle 14 on shaft 16. In normal use it can be seen that the external portion of the rotary connector 54 is stationary with respect to the handle grip portion 14 and both of these elements rotate with respect to shaft 16 and brush head 11. By providing a portion 56 of connector 54 overlapping the handle portion 14, the handle is held onto the shaft 16. If desired, a groove and snap ring arrangement as illustrated in FIG. 3 could also be included in this embodiment.

Insulated grip portions 52 are preferred in this embodiment for the same reasons they were included in FIG. 4 embodiment. In addition, it is anticipated in the FIG. 5 embodiment that brush head 11 should include a separate bristle sleeve 58 for fitting tightly over the body of brush head 11. Such a separate sleeve arrangement is not essential, but would provide a simple way of changing bristle types without disturbing any of the electrical part of the apparatus. It can be seen that this FIG. 5 embodiment provides an improved thermal path from heater 38 to the surface of the brush head 11 since there need be no air gaps between these two elements. As a result, the heater 38 operates at a lower temperature for a given surface temperature of brush head 11.

In this FIG. 5 embodiment, it is necessary to have some type of rotary electrical connection. Since the heater element 38 and conductors 42 rotate with the brush head 11, the rotary connector 54 is a preferred way of doing it. As an alternative, an embodiment similar to FIG. 4 is contemplated in which a pair of sliding electrical contacts is provided between the brush head 11 and handle 14 to supply power to a hollow cylinder electrical heater embedded in the brush head 11.

In use, the hot rolling hairbrush in FIGS. 4 and 5 can be used for any of the styling operations discussed above with respect to FIGS. 1, 2 and 3. In addition, it can be used in the same manner as a hot curler. That is, the heat from heater 38 can be used to set a curl formed around the rolling head 11. A preferred method of use involves styling after shampooing the hair. If the hair is toweled an almost dry condition and then shaped with the heated rolling brush, the brush will simultaneously aid in drying the hair and forming a hair style. In such an operation, the hot rolling hairbrush does not disturb the style like a blow dryer may. The rolling brush can be used as a curling iron, but the bristles help prevent contact of the heated surface of the brush head 11 with the skin and thus avoids burns. Thus the heated rolling hair brush can serve all the functions of a standard or rotary hair brushes, hot curlers, hair dryers and curling irons all at the same time.

While a particular brush head has been illustrated, it is apparent that other brush heads of smaller or larger diameters and having longer or shorter bristles may also employed. The bristles may also be replaced with comb-like teeth to improve certain styling effects. Other arrangements for holding the brush head onto the handle portion may be provided to allow for quick and simple replacement of the brush heads so that a variety of brush heads may be conveniently used with a single handle portion if so desired.

While the present invention has been illustrated in terms of particular apparatus it is apparent that other modifications and changes can be made within the scope of the present invention as defined by the appended claims.

We claim:

1. A manually operated rolling hairbrush comprising: a generally cylindrical brush head having bristles extending radially from its surface over a first portion of its length and having a gripping surface over a second portion of its length, a handle rotatably attached to said brush head adjacent the gripping portion of said brush head, and heater means carried within said brush head.

2. A rolling brush according to claim 1 wherein: said handle includes a shaft extending axially from one end thereof; said brush head has a cylindrical hole along its axis; said brush head is rotatably attached to said handle by being positioned on said shaft; said heater means is carried within said shaft, and further including electrical conductors extending through said handle to said heater for supplying power thereto.

3. A rolling brush according to claim 1 wherein: said brush head includes a shaft extending axially from said gripping portion; said handle has a cylindrical hole along its axis; said handle is rotatably attached to said brush head by being positioned on said shaft; said brush head has a central aperture in which said heater is carried; and further including electrical conductors passing through said shaft for supplying power to said heater.

4. A rolling brush according to claim 3 further including, operatively coupled to the end of said shaft opposite said gripping portion of said brush head, rotary conductor means connecting said conductors in said shaft to a power supply line whereby said brush head may be rotated without rotation of said supply line.

5. Apparatus according to claim 2 or claim 3 further including a thermal insulating surface on said handle and said gripping portion.

6. Apparatus according to claim 5 wherein said thermal insulating surface comprises a layer of cork material.

* * * * *